US005366409A

United States Patent [19]

Riley

[11] Patent Number: 5,366,409

[45] Date of Patent: Nov. 22, 1994

[54] CONTROLLING POURING STREAM AND RECEIVER ENVIRONMENT

[75] Inventor: Michael F. Riley, Danbury, Conn.

[73] Assignee: Praxair Technology, Inc., Danbury, Conn.

[21] Appl. No.: 155,265

[22] Filed: Nov. 22, 1993

[51] Int. Cl.[5] ..... F27B 1/10

[52] U.S. Cl. ..... 454/188; 432/10; 432/64

[58] Field of Search ..... 432/10, 64, 110, 179; 454/188, 189, 192

[56] References Cited

U.S. PATENT DOCUMENTS 4,823,680 4/1989 Nowotarski .

5,152,453 10/1992 Leturno ..... 228/219

5,195,888 3/1993 Sharma et al. ..... 432/64

5,210,959 5/1993 Brestovansky et al. ..... 432/11

OTHER PUBLICATIONS

*The Making, Shaping and Treating of Steel;* 10th Ed, 1985, pp. 750–751.

*Primary Examiner*—Harold Joyce

*Attorney, Agent, or Firm*—Peter Kent; Stanley Ktorides

[57] ABSTRACT

A method and system for providing a controlled gaseous environment at the opening to a receiver and around a free liquid stream downwardly entering the receiver opening. The method comprises laminarly emitting at least two gas flows to extend and intersect over the receiver opening thereby forming an upward plume enveloping the free liquid stream.

9 Claims, 3 Drawing Sheets

Fr = 0.25

Fr = 0.40

Fr = 0.50

CONTROLLING POURING STREAM AND RECEIVER ENVIRONMENT

BACKGROUND

Figure 1:
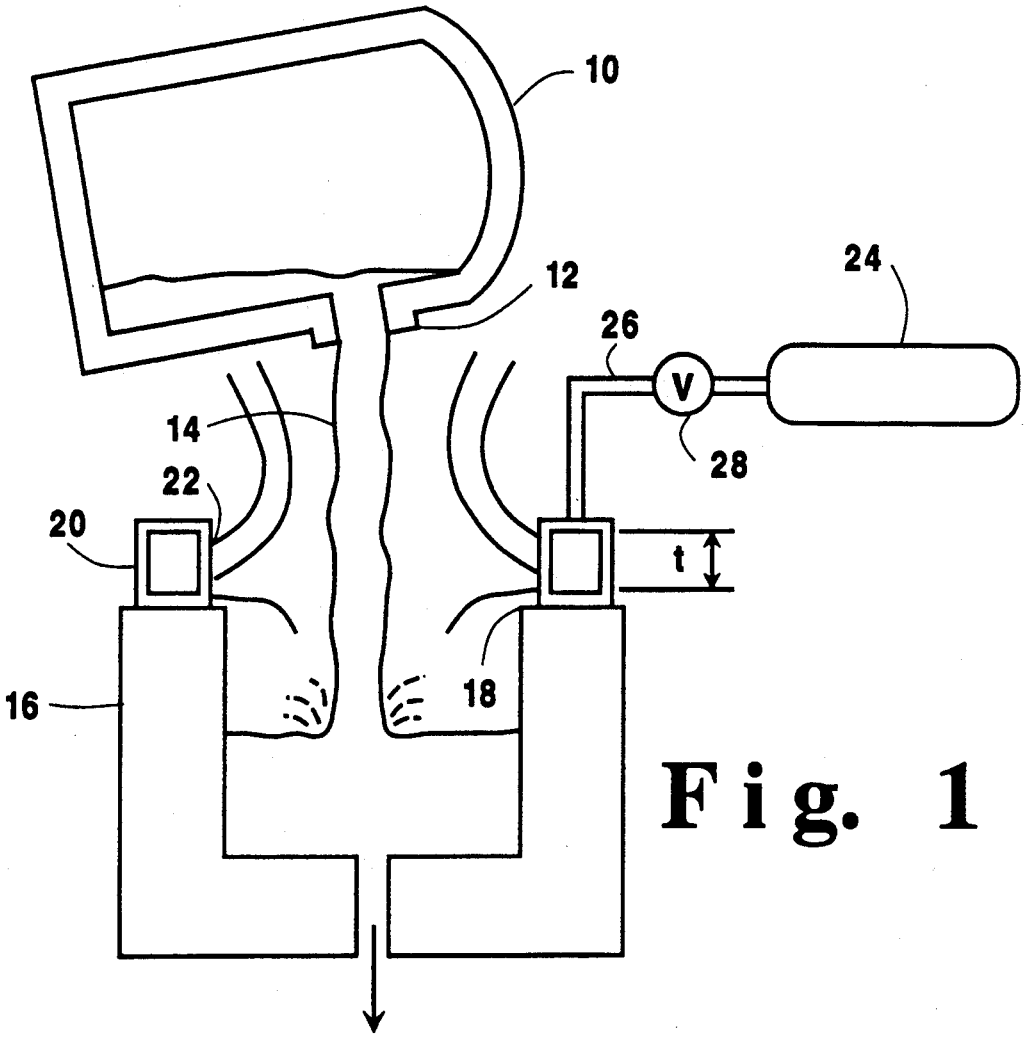

This invention relates to controlling the environment surrounding a free fluid stream entering a receiver.

Many organic and inorganic materials have adverse reactions upon contact with gases. For example, atmospheric oxygen may dissolve in hot metal, as when molten metal is exposed to air. The oxygen may oxidize some of the metal and degrade its properties. In production processes, metal often must be poured from one operating or holding container to another. In an example of frequent practice, a quantity of metal is melted in a furnace. The liquid metal is then poured from the furnace into a receiver such as a crucible, mold, ladle, or tundish. If the pouring is performed in air, the liquid stream is susceptible to the solution of, and oxidation by air.

Several methods have been used to protect a molten metal pouring stream. One method of protection is to enclose both containers, such as the furnace and the receiver, in an enclosure which is evacuated of air. This, however, adds considerable capital cost and cumbersomeness to the operation. All actions taken with the enclosed furnace must be by remote control through the wall of the enclosure. The enclosure also interferes with visual observation of the liquid levels in the furnace and receiver which may need to be controlled for proper processing and safety. Operating cost is high because of the power used to operate the vacuum pump, and the inert gas commonly used to backfill the enclosure to allow the molten metal to be removed from the receiver.

Another method is to pour the molten metal from the furnace to the receiver through a tube or shroud. However this is inconvenient and does not provide complete protection. Because the furnace is usually tilted for pouring, a rigid tube or shroud of fixed dimensions cannot be adjusted to the changing distance from the furnace spout and the receiver opening. Before pouring begins, the tube or shroud interior is ordinarily occupied by air which comes into contact with the liquid stream when pouring begins. In addition, the tube or shroud interferes visual observation of the liquid level through the receiver opening.

In another method, liquified inert gas, such as liquid nitrogen, is introduced into the receiver so that when liquid metal is poured into the receiver, the liquified gas can float on the surface of the liquid metal. The liquefied gas vaporizes into gas which displaces air from the receiver volume and rises from the receiver at least partially protecting the pouring liquid stream from exposure to air. This method adds considerable operating cost in that a considerable quantity of liquified gas is used. Further, the method presents a safety hazard in that liquified gas can be trapped under the molten metal, and subsequent rapid gasification of the trapped liquified gas can produce an explosion.

The problem of air oxidation of hot pouring metal is especially important in the production of metal powder. Metal powder is used to manufacture many metal articles by forming the powder under pressure and temperature into a desired shape. This powder metallurgy method is preferred for alloys which are difficult to cast or difficult to form mechanically. The powder metallurgy method may also be used to imbue a finished article with unusual properties related to the fine powder or the rapid speed of solidification of the powder.

Metal powder is produced by melting a quantity of metal and creating a stream of the molten metal which is atomized into droplets which solidify into powder. The atomization is usually carried out by directing a stream of molten metal through high-velocity jets of water, oil, or inert gas. While it is possible to tilt a furnace to pour a molten metal stream through atomizing jets, the efficiency of this process is compromised because it is difficult to control geometric relationships between the stream and the atomizing jets. Consequently solid metal is usually melted in a furnace, and the liquid metal is poured into a geometrically fixed tundish from which a stream of molten metal is directed to the atomizing jets.

What is needed is an inexpensive, unobtrusive method of providing a controlled protective environment for the receiver opening and the free stream entering the receiver opening.

SUMMARY

This invention satisfies the above needs. The invention provides a method for providing a controlled gaseous environment at the opening to a receiver and around a free liquid stream downwardly entering the receiver opening. The method comprises laminarly emitting, at a modified Froude number from about 0.2 to about 0.5, at least two gas flows to extend and intersect over the receiver opening thereby forming an upward plume enveloping the free liquid stream.

The method can be practiced in a system comprising:

(a) a receiver having an opening with a perimeter and a plane;

(b) at least one diffuser mounted near at least a portion of the perimeter of the receiver opening for emitting at least two gas flows over at least a portion of the receiver opening so as to produce an intersection of the flows and a rising gas plume over the opening;

(c) an emitting area in each diffuser, each emitting area having a height and capable of emitting a laminar gas flow;

(d) a gas source in communication with each diffuser;

(e) means for controlling gas supply to each diffuser to emit flow laminarly at a modified Froude number within the range of from about 0.2 to about 0.5; and (f) an origin for a free liquid stream, the origin located not further from the plane of the receiver opening than approximately five times the height of an emitting area so as to be within the gas plume.

Preferably the free stream origin is located not further from a line perpendicular to the plane of the receiver opening and passing upward through a location for intersection of the gas flows than approximately the height of an emitting area.

DRAWINGS

Figure 6:
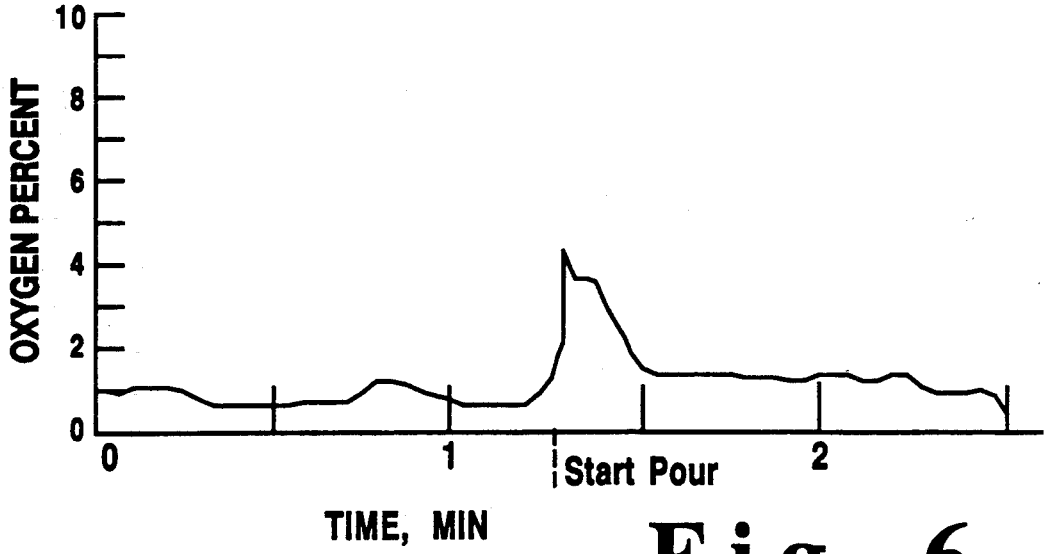
Figure 2:
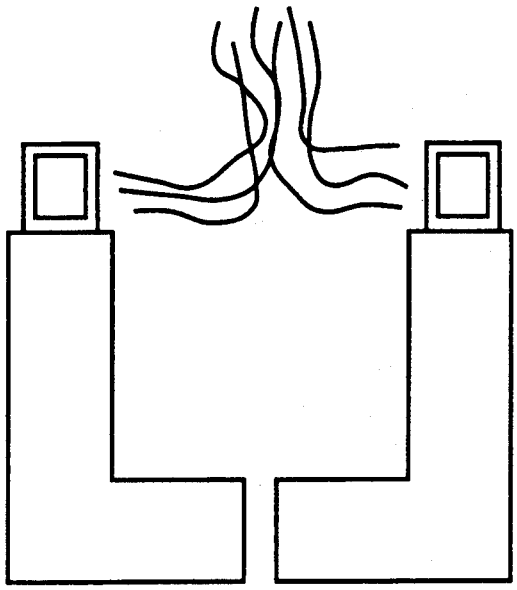
Figure 3:
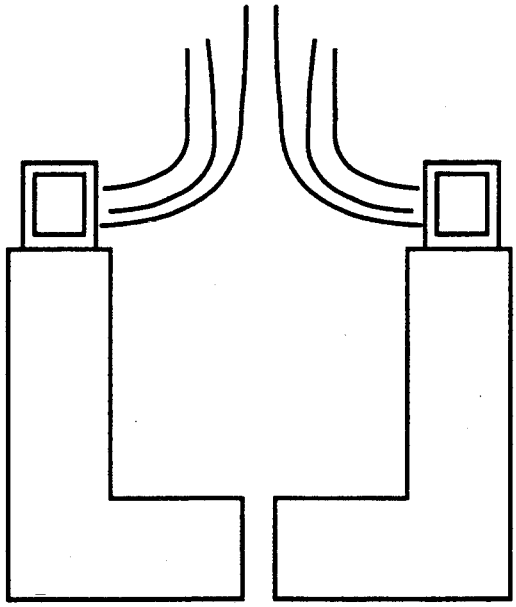
Figure 4:
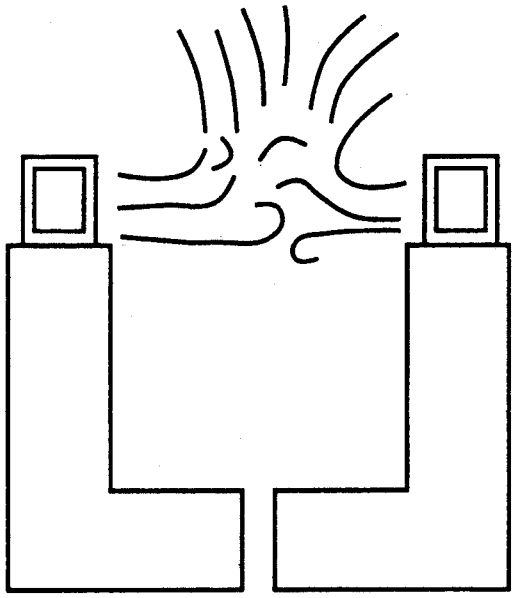
Figure 5:
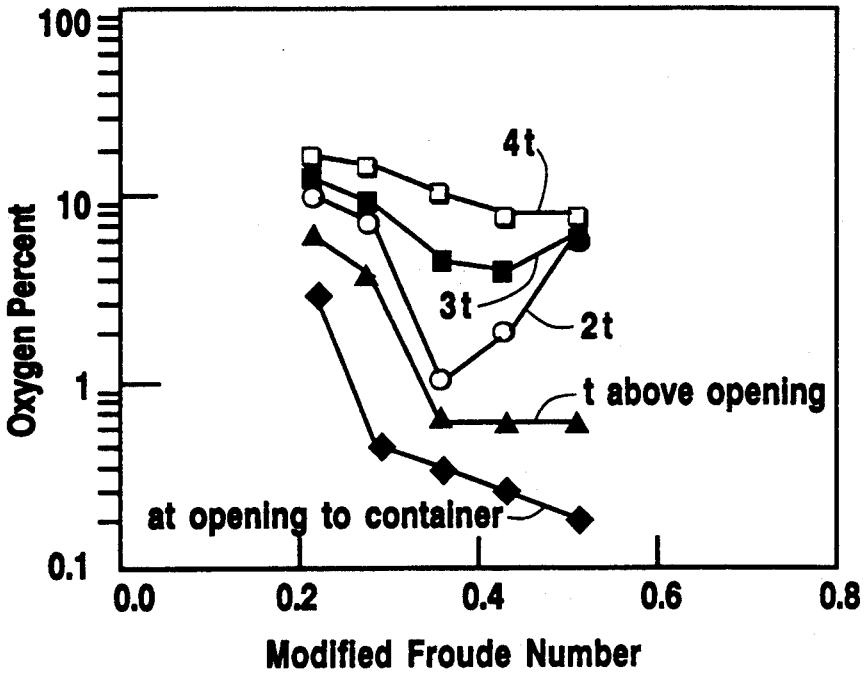

These and other features, aspects and advantages of the present invention will become better understood with reference to the following description, appended claims and accompanying drawings where FIG. 1 is a cross-sectional diagram of a system embodying the invention;

FIG. 2, FIG. 3 and FIG. 4 are cross-sectional diagrams showing flow patterns obtained at three different values of modified Froude number for flows emitted from diffusers over an opening pursuant to the practice of the invention;

FIG. 5 is a graph of oxygen concentration measured in the gas plume above the center of the opening to a tundish at several elevations corresponding to multiples of diffuser emitting area height where the gas plume was produced by diffusers emitting nitrogen gas flows at various values of modified Froude number; and FIG. 6 is a graph of oxygen concentration measured within the free volume of a tundish provided with a protective nitrogen gas environment pursuant to this invention, where oxygen concentration is shown over time before and after the start of pouring of a molten metal stream into the tundish.

DESCRIPTION

The invention is described as applied to a free stream of molten metal poured from a furnace into a receiver or container such as a ladle or tundish. The invention provides a controlled gaseous environment around the free stream of molten metal and in the unoccupied volume or headspace of the receiver or container. Referring to FIG. 1, a furnace 10 has a spout 12 which is the origin of a free stream 14 of liquid metal when the furnace is tilted for pouring. The liquid stream enters a receiver 16 through an opening 18. Mounted near the perimeter of the opening 18 are two diffusers 20, each comprised of a linear segment of duct with closed ends and an emitting area 22 oriented to emit a gas flow over at least a portion of the opening. Preferably each of the two diffusers is equal in length to the diameter of the opening. More than two diffusers can be employed, and the diffusers may be curvilinear to conform more closely to the perimeter of the opening.

Preferably the diffusers will be oriented to emit flows parallel and opposite to each other. While typically the diffusers will also be oriented to emit gas flows parallel to the plane of the receiver opening, the diffusers can also be oriented to emit at a small angle downward, for example 15°, or at a small angle upward, from the plane of the opening. Notwithstanding, the diffusers are oriented so their emitted flows will flow towards and meet usually at a line passing through, or a point at, the approximate center of the opening. Some of the flow will then become a downward circulatory flow within the unoccupied receiver volume. Most of the flow will become an upward flow or plume rising from the plane of the opening. The plume envelops the free stream entering the opening.

An annular diffuser surrounding the perimeter of the opening may also be employed. Preferably the annular diffuser is internally divided into two or more sections from each of which the mass rate of flow of gas can be controlled and thus the location of the plume varied.

Typically the emitting area of each diffuser is of a height (designated as "t" in FIG. 1) equal at least to 5% of the distance over which its emitted flow is intended to extend over the receiver opening. The diffuser emits flow of an original thickness equal to the height of its emitting area. Typically an emitted flow is intended to intersect with another emitted flow at approximately the center of the receiver opening. Hence, typically, the distance over which a fluid layer is intended to extend is half the width of the opening plus any distance from the emitting face of the diffuser to the perimeter of the opening.

Each diffuser 20 or each diffuser section communicates with an external source 24 of fluid via a conduit 26 and a flow control valve 28 which is adjustable to vary the meeting location or intersection location of the gas flows over the receiver opening. Preferably the entry of the free stream into the opening is approximately no further from the intersection of the flows over the opening than the height of a diffuser emitting area, or the original thickness of a flow. Either the origin of the free stream or the intersection of the gas flows may be adjusted to achieve this condition. Thus most of the gas flow will became an upward gas plume enveloping the free stream.

Preferably the origin of the free stream is located not further from the plane of the receiver opening than approximately five times the original thickness of a gas flow. In practice, before starting the free stream, it is desirable to establish the gas flow from the diffusers and create an upward gas plume which envelops the intended origin of the free stream flow, namely the end of the spout emanating from the furnace. By this method, the amount of air momentarily induced into the plume and into the receiver opening by starting of the free stream flow is reduced. The spout end is desirably kept within the upward flow from the receiver opening throughout the pouring duration.

The emitting area of each diffuser is capable of laminarly emitting a gas flow. Laminar flow is considered to exist when the root mean square of random fluctuations in gas velocity does not exceed 10% of the average velocity of the gas in its direction of flow at the origin of a layer, and the root mean square of the sizes of turbulent eddies in a gas layer does not exceed 10% of the thickness of the gas layer at its origin. The emitting area may be a free opening or an opening covered by a porous, permeable or perforated surface. A preferred material is sintered porous metal having a pore size of from about 0.5 micrometers to about 100 micrometers, most preferably from about 2 micrometers to about 50 micrometers. For protection from external damage, the porous surface may be covered with a screen preferably having a mesh size of from about 1 to about 50 openings per centimeter.

In practice, each diffuser flow control is adjusted so that each diffuser laminarly emits a gas layer with a modified Froude number in the range of from about 0.2 to about 0.5, preferably from about 0.3 to about 0.5. The modified Froude number is a dimensionless parameter useful as a criterion of dynamic similarity for fluid layers and is defined as:

$$F = Q/A\sqrt{\rho_e/(\rho_a - \rho_v)gt}$$

where Q is the volumetric flow rate of gas provided to a diffuser to establish the gas flow, A is the area covered by the gas flow, $\rho_e$ is the mass-flow-weighted average of the density of the gas emitted by the diffuser, $\rho_a$ is the density of the atmospheric air above the emitted flow, $\tau_v$ is the density of the gas within the unoccupied receiver volume, g is the acceleration of gravity, and t is the original thickness of the gas flow, that is, its thickness at its origin.

Nitrogen gas is usually supplied to the diffusers for emission. However other gases, for example, such as argon, carbon dioxide, helium, carbon monoxide, hydrogen, or mixtures thereof may be used.

EXAMPLE 1

Pursuant to the practice of the invention as described above, on the top surface of a receiver, adjacent to the perimeter of an opening with a diameter of 13 centimeters into the receiver, were mounted two diametrically-opposed linear diffusers, each having a length of centimeters. The emitting areas in the diffusers were sintered porous metal approximately 3.8 centimeters high. Nitrogen gas was laminarly emitted from the diffusers at given values of modified Froude number. Smoke was injected into the gas layers at various locations to visualize the flow pattern.

At a modified Froude number of about 0.25, as depicted in FIG. 2, the flow across the opening was smooth and laminar. However, the gas velocity decayed from viscous interaction with the surrounding stagnant atmosphere so that where the two gas flows met the laminar nature of the gas flows was dissipated. The resulting upward plume was not stable and consisted of wisps of nitrogen gas mixing with the surrounding air.

At a modified Froude number of about 0.4, as depicted in FIG. 3, the flow across the opening was smooth and laminar. Where the two flows met there was an orderly transition into a stable upward plume of nitrogen gas.

At a modified Froude number of about 0.5, as depicted in FIG. 4, the two flows met with enough momentum to induce turbulent mixing. This turbulence caused ambient air to mix into the upward plume thereby raising the oxygen content of the plume. The upward plume was stable, however.

EXAMPLE 2

Pursuant to the practice of the invention as described above, on the top surface of a tundish, adjacent to the perimeter of an opening with a diameter of 13 centimeters into the tundish, were mounted two diametrically-opposed linear diffusers, each having a length of 25 centimeters. The emitting surfaces in the diffusers were sintered porous metal approximately 3.8 centimeters high. Nitrogen gas was laminarly emitted from the diffusers at given values of modified Froude number. The oxygen content was measured at the plane of the opening at its center and directly above at heights of one, two, three, and four times the height of the diffuser emitting surfaces.

Extrapolation of the results shown in FIG. 5 indicates that even at an elevation above the center of the tundish opening of five times the height of a diffuser emitting surface, the oxygen content is reduced from that of atmospheric air. Reduced oxygen concentrations relative to atmospheric air occurred over a range of modified Froude number exceeding from about 0.2 to about 0.5. A preferred effective operating range of modified Froude number is from about 0.3 to about 0.5.

EXAMPLE 3

Pursuant to the practice of the invention as described supra, on the top surface of a tundish, adjacent to the perimeter of an opening with a diameter of 13 centimeters into the tundish, were mounted two diametrically-opposed linear diffusers, each having a length of 25 centimeters. The emitting surface in the diffusers was sintered porous metal approximately 3.8 centimeters high. Nitrogen gas was laminarly emitted from the diffusers at a modified Froude number of 0.4. Before the pouring from the furnace began, the furnace was located so that its pouring spout was within the upward plume from the diffusers, not further from the center of the opening to the tundish than four times the height of a diffuser emitting surface. The furnace was tilted maintaining the pouring spout within the upward plume and not further from the center of the opening to the tundish than five times the height of a diffuser emitting surface. The oxygen concentration was measured as a function of time at the center of the interior volume of the tundish.

Results are shown in FIG. 6. Diffuser flow was established before the start of pouring, resulting in an oxygen concentration at the measurement location of about 1%. At the start of pouring, the oxygen concentration momentarily increased to about 5%, and then decreased to about 1.7%. Starting the pouring with the spout end in ambient air outside of the upward plume would have caused an even larger concentration spike of oxygen than observed in these data, because the starting stream would have dragged air with it.

Although the invention has been described with reference to specific embodiments, it will be appreciated that it is intended to cover all modifications and equivalents within the scope of the appended claims.

What is claimed is:

1. A method for providing a controlled gaseous environment at the opening to a receiver and around a free liquid stream downwardly entering the receiver opening, said method comprising laminarly emitting, at a modified Froude number from about 0.2 to about 0.5, at least two gas flows to extend and intersect over the receiver opening thereby forming an upward plume enveloping the free liquid stream.

2. The method as in claim 1 wherein said gas flows are emitted at a modified Froude number within the range of from about 0.3 to about 0.45.

3. The method as in claim 1 wherein a gas flow at its source is emitted with an original thickness at least 5% of the distance over which the flow extends over the opening.

4. The method as in claim 1 further comprising locating the origin of the free stream not further from the plane of the receiver opening than approximately five times the original thickness of a flow.

5. The method as in claim 1 wherein the free stream enters the receiver opening not further from the intersection of said at least two gas flows than approximately the original thickness of one of the flows.

6. The method as in claim 1 further comprising adjusting the gas emission rates so that the intersection of the gas flows is not further from the entry of the free stream into the receiver opening than approximately the original thickness of one of the flows.

7. An system for providing a controlled gaseous environment at the opening to a receiver and around a free stream of liquid discharging from an origin downwardly into the receiver opening, said system comprising:

(a) the receiver having the opening with a perimeter and a plane;

(b) at least two diffuser mounted on opposite sides and near at least a portion of the perimeter of the receiver opening for emitting at least two gas flows over at least a portion of the receiver opening so as to produce an intersection of the flows and a rising gas plume over the opening;

(c) an emitting area in each diffuser, each emitting area having a height and capable of emitting a laminar gas flow;

(d) a gas source in communication with each diffuser;

(e) means for controlling gas supply to each diffuser to emit flow laminarly at a modified Froude number within the range of from about 0.2 to about 0.5; and (f) an origin for a free liquid stream, said origin located not further from the plane of said receiver opening than approximately five times the height of an emitting area so as to be within the gas plume.

8. The apparatus as in claim 7 wherein the free stream has an origin located not further from a line perpendicular to the plane of the receiver opening and passing upward through a location for intersection of the gas flows than approximately five times the height of an emitting area.

9. The apparatus as in claim 8 wherein said gas emitting area has a height at least 5% of the distance over which the gas flow is intended to extend over the receiver opening.

* * * * *